US008517635B2

(12) United States Patent
Onofri et al.

(10) Patent No.: US 8,517,635 B2
(45) Date of Patent: Aug. 27, 2013

(54) ADJUSTABLE FLOATABILITY DEVICE

(76) Inventors: Jean-Michel Onofri, Salon De Provence (FR); Etienne Clamagirand, Grans (FR)

( * ) Notice: Subject to any disclaimer, the term of this patent is extended or adjusted under 35 U.S.C. 154(b) by 330 days.

(21) Appl. No.: 12/745,716

(22) PCT Filed: Dec. 4, 2007

(86) PCT No.: PCT/FR2007/052438

§ 371 (c)(1),
(2), (4) Date: Aug. 18, 2010

(87) PCT Pub. No.: WO2008/081127

PCT Pub. Date: Jul. 10, 2008

(65) Prior Publication Data

US 2010/0304629 A1 Dec. 2, 2010

(51) Int. Cl.
*B63C 9/08* (2006.01)

(52) U.S. Cl.
USPC ..... 405/186

(58) Field of Classification Search
USPC ..... 405/186; 114/315; 441/88, 90, 441/92, 96; 137/81.2
See application file for complete search history.

(56) References Cited

U.S. PATENT DOCUMENTS 3,054,414 A * 9/1962 Blackwell ..... 137/81.2
3,179,118 A * 4/1965 Mitchell et al. ..... 137/505.46
3,436,777 A * 4/1969 Greenwood ..... 405/186
3,495,607 A * 2/1970 Shugarman ..... 137/81.2
3,920,033 A * 11/1975 Ferrando ..... 137/81.2
4,054,132 A 10/1977 Deeds
4,561,853 A * 12/1985 Faulconer et al. ..... 441/106
5,221,161 A 6/1993 Toy
5,403,123 A * 4/1995 Walters ..... 405/186
5,542,446 A * 8/1996 Rose ..... 137/81.2
5,660,503 A 8/1997 Lewis
5,810,041 A * 9/1998 Garofalo ..... 137/81.2
5,980,158 A * 11/1999 Griffiths et al. ..... 405/186
6,341,921 B1 * 1/2002 Anderson et al. ..... 405/186
2004/0142801 A1 * 7/2004 Lin ..... 482/142
2007/0155601 A1 * 7/2007 Dykgraaf et al. ..... 482/140

FOREIGN PATENT DOCUMENTS

GB 1532411 A 11/1978

OTHER PUBLICATIONS

International Search Report.

* cited by examiner

*Primary Examiner* — Sunil Singh
(74) *Attorney, Agent, or Firm* — Harness, Dickey & Pierce, PLC

(57) ABSTRACT

The invention relates to a buoyancy device with a constant and adjustable volume intended for any submersible entity capable of submersion at various depth, and comprising at least one float with a flexible member and filled with gas, the pressure of which is adjusted according to the submersion depth, and such that: the membrane is elastic and defines a gas volume that varies according to the elasticity of said membrane and to the relative inner pressure of said volume relative to the outer environment pressure. An expander-discharge system is used for supplying and emptying the gas to or from the inner volume of the float.

10 Claims, 5 Drawing Sheets

1c
2
3
17
4
5
6
16
7
1b
9
10
8
12
13
14
20
15
1a
33
$33_2$
$30_2$
18
$31_2$ $30_2$
$31_2$
A
A'
$30_2$
20
15

ADJUSTABLE FLOATABILITY DEVICE

FIELD

The present invention relates to floatability devices having constant and adjustable volume.

The technical sector of the invention is that of producing such adjustable floatability devices designed for any submersible entity capable of immersing to different depths, such as an undersea diver who must compensate at any given moment, either for an excess of weight so as not to sink, or a floatability surplus so as not to rise to the surface.

BACKGROUND

Stabilisation buoys used in particular by autonomous divers are known which, when they change depth during diving, must compensate manually for the volume of their buoy, either by injecting air originating from the first-stage expander of their gas bottle, or by purging the buoy by acting on purge valves located at different places in the latter; this is necessary at each change in depth as the volume of air/gas of the buoy is modified with the variations in pressure associated with this change in depth and must therefore be adjusted permanently or otherwise not allow the diver to stabilise at the desired depth.

In addition, since such a buoy is made from a supple bladder generally made of polyurethane, the air/gas is always located in its upper part, which makes movements by the diver carrying said buoy difficult and, when the latter is deflated, its form is generally not hydrodynamic.

The problem posed is therefore to produce an adjustable floatability device in a predetermined range, at a preferred volume value which must then remain constant during change in depth without intervention of the operator, offering the latter a constant reserve floatability, irrespective of the ascending and descending shifts of the submersible entity to which the device is attached; and when this entity is the diver operator himself, this device must allow him ease of movement and must have the most hydrodynamic form possible.

A solution to the problem raised is a floatability device having constant and adjustable volume designed for any submersible entity, capable of immersing to different depths, and comprising at least one float with a supple membrane filled with gas and whereof the pressure is regulated as a function of the immersion depth, and such that this membrane is elastic and delimits a gas volume which is a function of the elasticity of this membrane and of the relative internal pressure of said volume in relation to the external ambient pressure, an expander-discharge system ensuring supply and purging of said gas to or from said internal volume of the float.

SUMMARY

In a preferred embodiment, said float comprises a rigid base on which said supple membrane is fixed and held, the latter determining with said rigid base said gas volume of the float, and the expander-discharge is a regulator for supply and gas purge, such that the internal pressure of the latter in the volume of the float relatively relative to the external ambient pressure is quasi kept at a predetermined value corresponding to a preferred and therefore constant floatability volume.

Also, according to the present invention, the material from which the elastic membrane is made is selected such that its module of elasticity remains quasi constant in the deformation zone, creating the preferred floatability volume, this deformation being a quasi monotonous and biunivocal function of the relative internal pressure of the float.

Other particular features and characteristics of the present invention are specified within the scope of the description and figures hereinbelow.

The result is a novel floatability device which automatically retains a constant volume at a value selected by the operator, such as a diver, irrespective of the immersion depth of the latter.

Such a device can comprise several floats which can be distributed around a submersible entity, such as the diver himself, in such a way that when immersed their resulting centre of total thrust is quasi combined with the centre of gravity of said entity or of the diver, allowing him to make easier changes in position.

The characteristics of the float according to the invention give it a hydrodynamic form, irrespective of its inflation volume and the design of the expander-discharge allows a decrease in size of purge valves relative to those of buoys of current constant volume, which, due to the fact that they operate at low differential pressure, require large diameters for air/gas to pass through.

Other advantages of the present invention could be cited, but those cited hereinabove are already sufficient to demonstrate its novelty and interest.

DRAWINGS

The description and attached diagrams illustrate embodiments of the invention but are non-limiting: other embodiments are possible within the scope of the reach and the extent of the present invention, such as in particular in the form and embodiment of floats and their base.

DETAILED DESCRIPTION

Figure 1B:
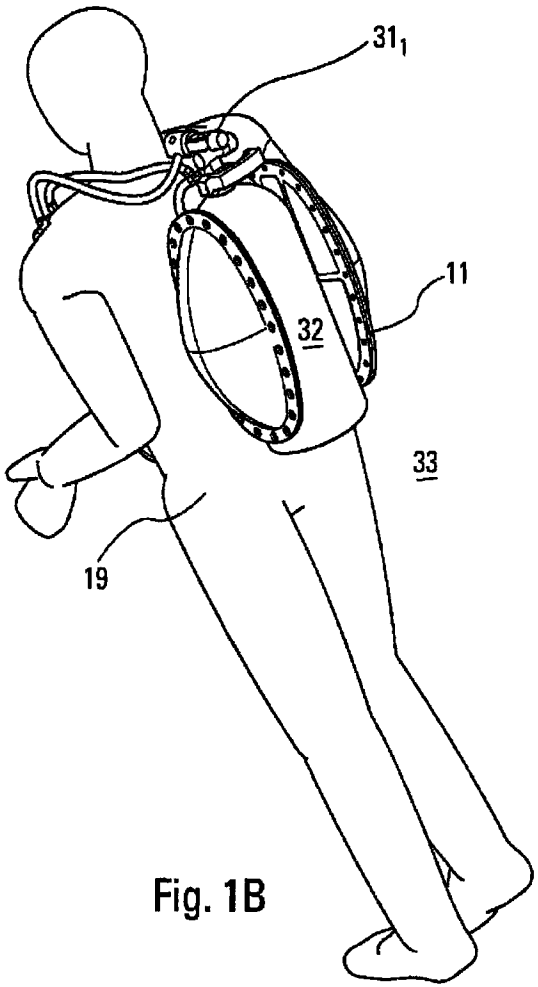
FIGS. 1A and 1B illustrate a device according to the invention as worn by a diver.
Figure 1A:
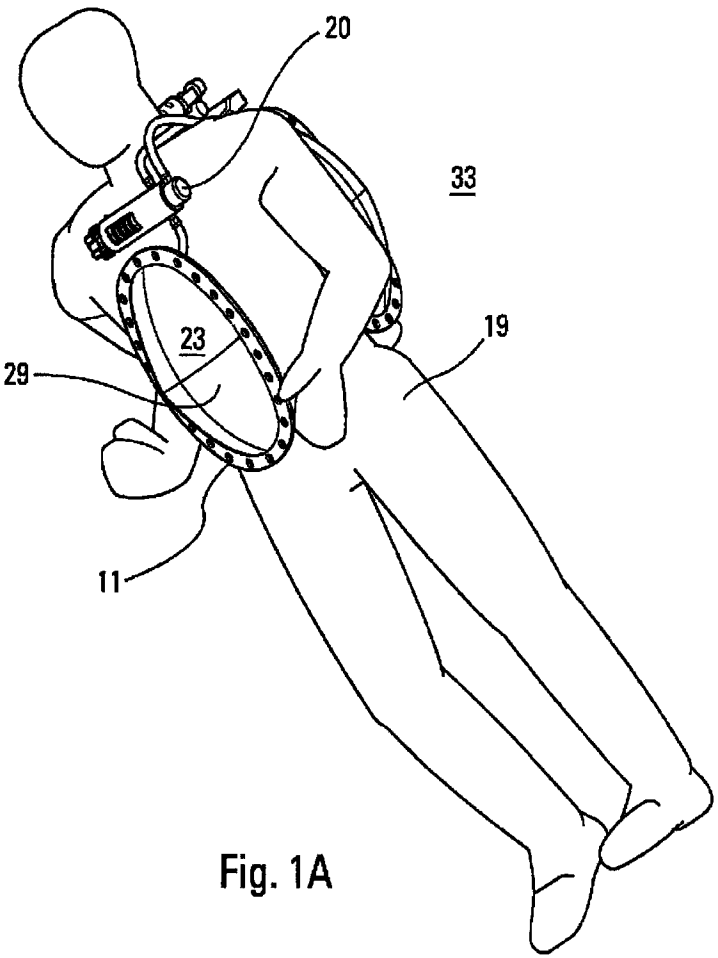

In the present description, it is considered that the submersible entity is a diver 19 carrying a bottle or gas or air reserve 32 on his back, such as illustrated in FIG. 1B, capable of supplying, because of a first-stage expander $\mathbf{31}_1$ and an expander-discharge regulator 20, different floats 11 connected in parallel such as the three illustrated in FIG. 1, one on the chest of the diver 19 and the two others on either side of the air tank 32.

The regulator 20 makes reference to the external ambient pressure 33 and, such as defined hereinbelow, regulates the differential pressure inside the floats 11 and said ambient external pressure hereinbelow.

Once this differential pressure is regulated, the volume of the floats 11, which can vary from 0 to 6 liters for example for pressure adjustable varying from 0 to 1 bar, remains constant, irrespective of immersion.

For this, each float 11 comprises a supple elastic membrane 23, fixed and held on a rigid base 25. Said rigid base 25 is preferably convex and the elastic membrane 23 is arranged and pretensed against the convex face of this base 25 prior to any filling of gas or air.

To ensure proper tightness between the elastic membrane and said base, the latter comprises at least one peripheral groove 26 which cooperates with a throat 22 of a counterflange 21 which is fixed on the rigid base outside the groove 26 by sandwiching the edge of said membrane 23.

The base, the membrane and the counterflange can be fixed by tightening bolts 34 passing through these three elements and without requiring strong tightening due to the groove-throat characteristics hereinabove.

The initial tension of the membrane, preferably made of elastic high-limit and strong elongation elastomer, is calculated to let this membrane 23 work in a zone where its module of elasticity is almost constant or at the very least such that its deformation is a monotonous and biunivocal function of the pressure: the thickness and the mechanical characteristics of the membrane are selected to have any given volume at maximum outlet pressure, to the float 11, selected for the regulator 20.

The air or the gas is injected between the convex surface of the rigid base 25 and the membrane via an inlet/outlet orifice 28 and a connection 30 connecting each float 11 to the expander-discharge regulator 20 so as to produce a predetermined internal volume 29.

The convex base 25 comprises stiffeners 27 in its concave external part dimensioned to prevent any deformation of the base under pressurisation. To improve tightness of the membrane 23, made by moulding, the latter can comprise a bulge 24 which penetrates the throat 22 of the counterflange 21 in which it is crushed by the groove 26 of the base 25.

Figure 2A:
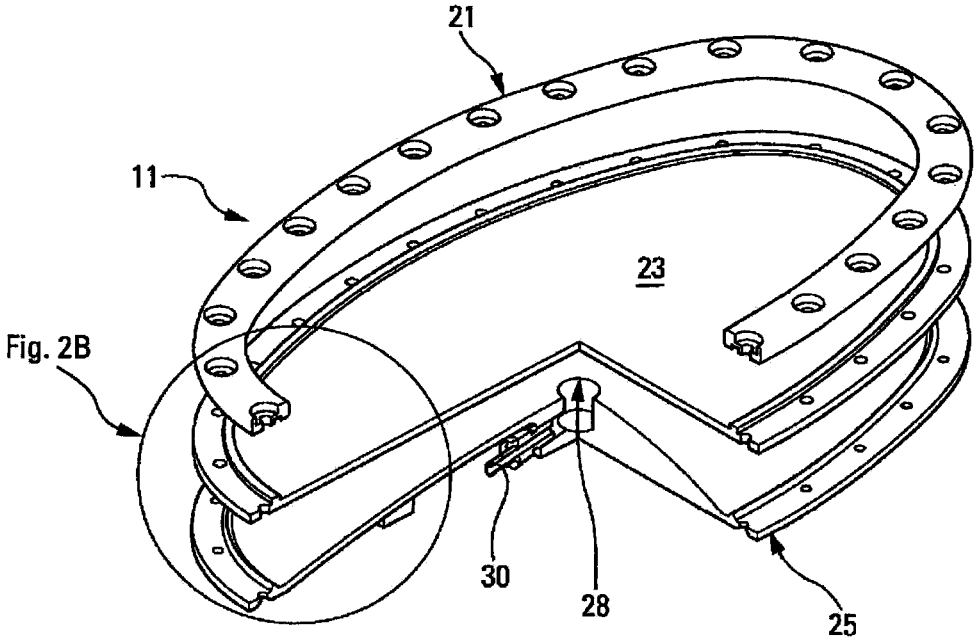
FIGS. 2A to 2F illustrate different views of a float according to the invention.
Figure 2B:
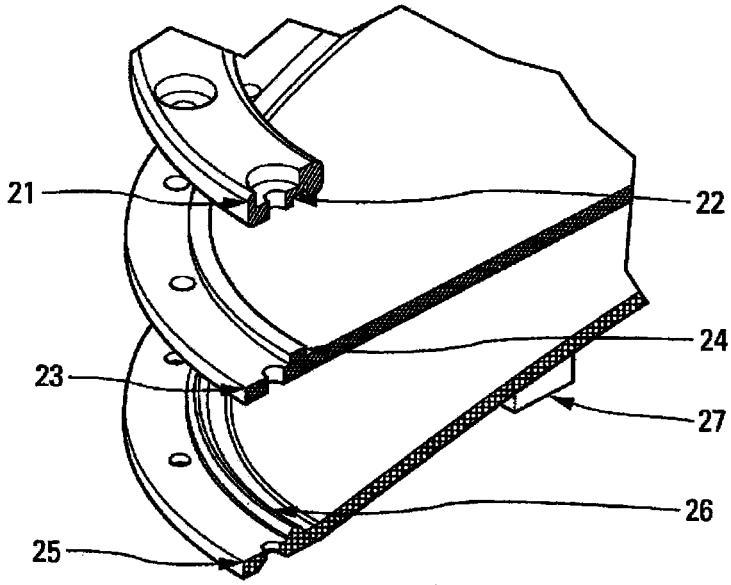
Figure 2C:
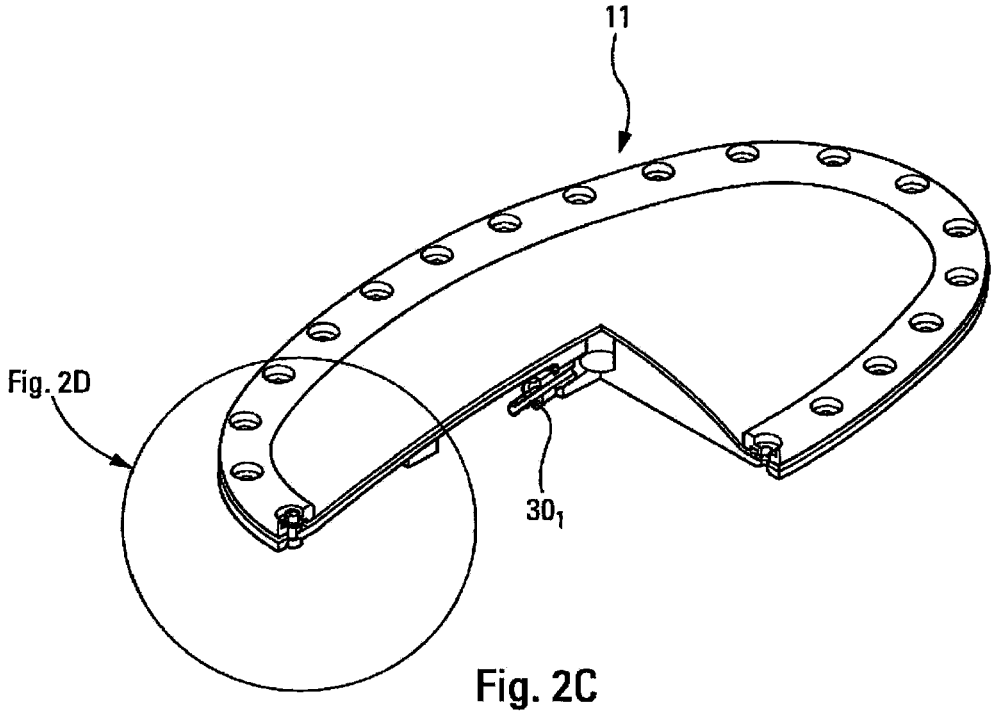
Figure 2D:
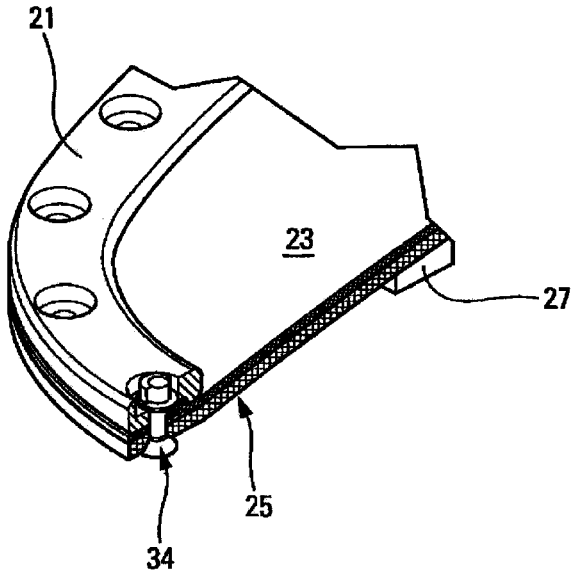
Figure 2E:
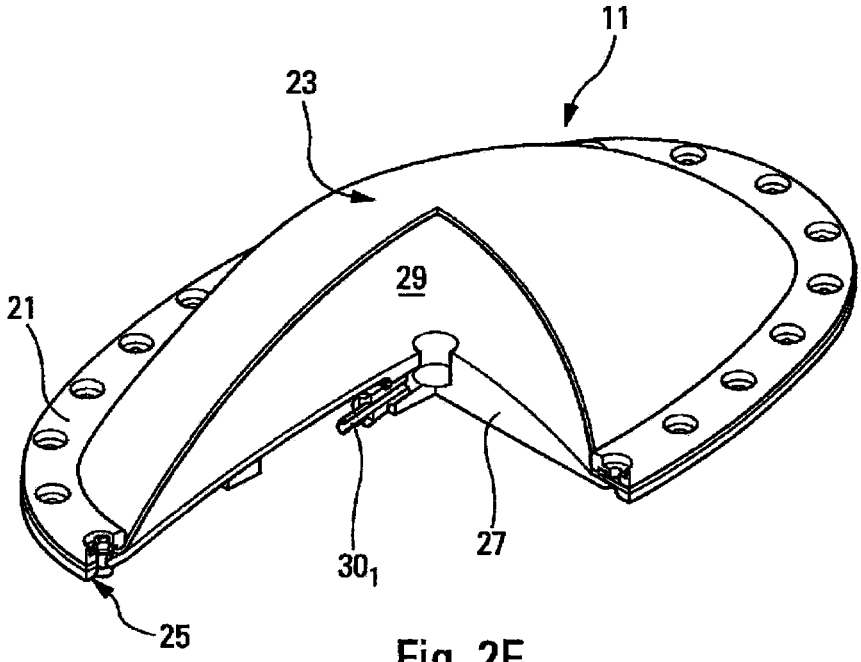
Figure 2F:
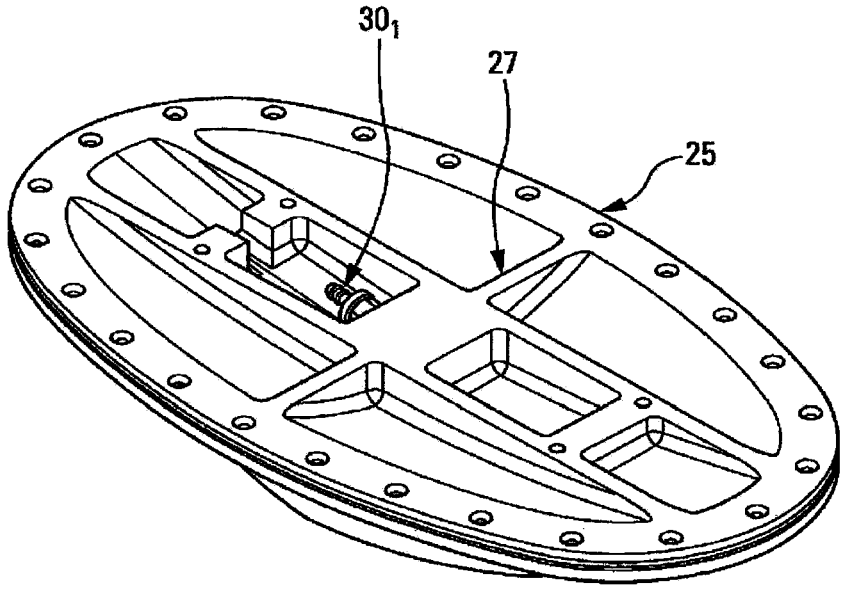

FIG. 2A is an exploded view of a base, a membrane and a counterflange constituting a float 11 with a detailed view 2B; FIGS. 2C and 2D illustrate the same elements as FIGS. 2A and 2B but assembled by a system such as screw bolts 34 or any other clamping system. FIG. 2E is a view of a float 11 in active position with air or gas blown in its internal volume 29, and FIG. 2F is a bottom plan view of the concave part of the base 25 by way of example.

Figure 3B:
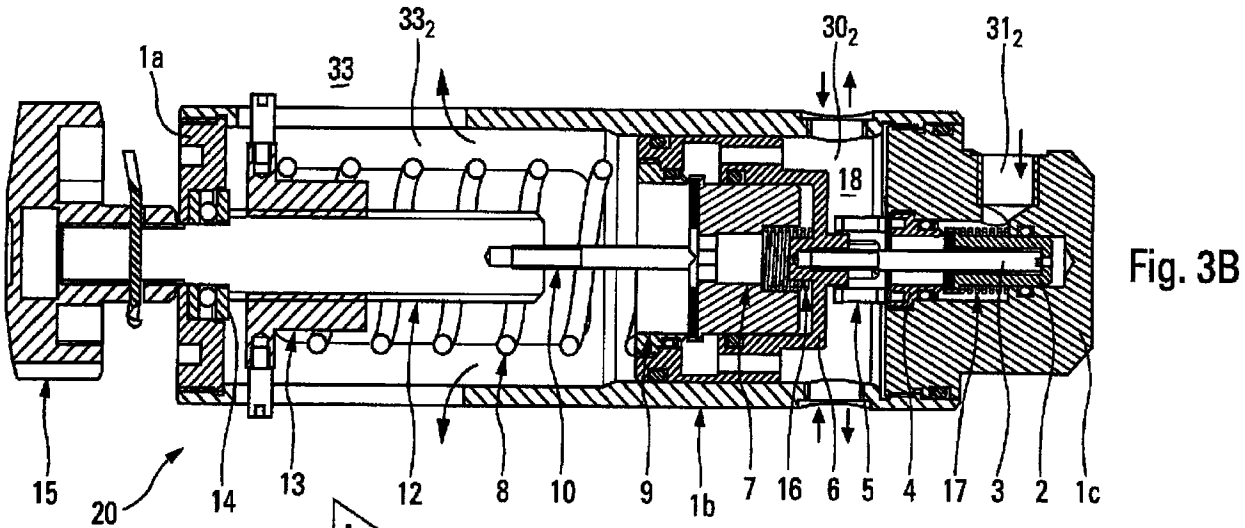
FIGS. 3A and 3B illustrate respectively a perspective and sectional view, along A, A' of FIG. 3A, of an expander-discharge according to the present invention.
Figure 3A:
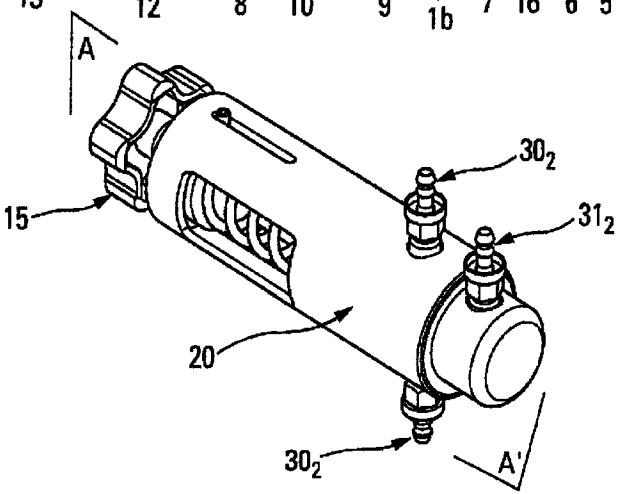

According to FIGS. 3A and 3B, the expander-discharge system 20 according to the invention is constituted by a single regulator block comprising a body or external envelope 1 constituted by several parts whereof a hollow central unit $\mathbf{1}_b$ of cylindrical form taking up the elements hereinbelow, and ends $\mathbf{1}_a$, $\mathbf{1}_c$ screwed and closing this central part: in the latter the purge valve 7, allowing gas to escape to the exterior 33 via the purge orifices $\mathbf{33}_2$, from the interior of the float 11 via the connection 30 of the latter towards the orifice $\mathbf{30}_2$ of the expander-discharge 20, is integrated into the pressure-adjustment piston 6 which bears the seat 9 of the purge valve 7, and which also ensures control of the supply valve 2 in gas or air via the orifices $\mathbf{31}_2$ originating from the expander $\mathbf{31}_1$ and towards the inside of the float 11 via said orifices $\mathbf{30}_2$; the valve 2 and the orifices $\mathbf{31}_2$ being located in an end part $\mathbf{1}_c$ of the body 1.

Each purge valve 7 and feed valve 2, comprising a joint solid with a face of a piston being supported against its closing seat, is compensated, that is, the internal surface delimited by said support seat on the face of the seal-bearing piston is equal to the surface of the face opposite the piston and subjected to the same downstream pressure because of a borehole made in said piston and making said two faces communicate, the upstream pressure being exerted only on part at least of the lateral faces of the piston. The effort required to open said valves depends neither on upstream pressure nor on downstream pressure, but only on the compression effort of the springs 16 and 17 which ensure tightness of said valves on their support seat. Said springs are selected with the weakest possible stiffness constants so as to reduce the adjustment error of the upstream and downstream differential pressure which will ensure opening of the valves: for example for a piston of 20 $cm^2$, a spring compression force of 5 Newton represents an adjustment insensitivity of 0.025 bar.

The helicoidal spring 16 is supported at one of its ends inside the piston 6 and at its other end on the purge valve 7, which valve is limited in its displacement, caused by the thrust of the spring 16, by a stop 10 solid with the body 1, due to a screw 12 described hereinbelow and borne by the end part $\mathbf{1}_a$ of the latter opposite that of $1_c$ bearing the valve 2, and arranged to the side of the spring 8 defined hereinbelow.

The helicoidal spring 17 is supported per se at one of its ends against the body 1 of the regulator block 20 and at its other end on the supply valve 2, the seat 4 of said valve being solid with the body 1 of the regulator block 20.

A third helicoidal spring 8, as mentioned hereinabove, is supported at one of its ends on a stop 13 solid with the body 1 of the regulator block 20 and adjustable by a roller 15, and at its other end on the piston 6, which piston being balanced on one side by its spring 8 and the external ambient pressure 33, and on the other side by the inflation pressure of the float 11.

Accordingly, the operating mode of such an expander-discharge is such that air or supply gas arriving via the orifice $\mathbf{31}_2$ passes via the valve 2 to inflate the floats 11 via a chamber 18 closed by the piston 6: the latter is therefore balanced by the action of the spring 8 supported on the adjustable stop 13 by the roller 15 acting on a screw 12 supported on a stop roller 14 and the hydrostatic pressure on one side and the action of the inflation pressure of the float on the other side.

If during a change in depth, such as more substantial immersion, the pressure inside the float 11 becomes lower than the action of the spring 8 added to by the action of the hydrostatic pressure which has actually increased, the piston 6 moves with the rod 3 which pushes and causes opening of the balanced flush valve 2 and which admits air or supply gas into the float 11 until the equilibrium of the piston 6 recloses the supply or flush valve 2.

A stop 5 limits displacement of the piston 6 in the event of substantial imbalance in order to limit effort on the rod 3.

Inversely, such as when the immersion depth is decreased, if the pressure in the float 11 is stronger than the action of the spring 8 added to by the action of the hydrostatic pressure, which then has a diminished effect, the piston 6 moves in the other direction and the rod 10 which is fixed then blocks the balanced purge valve 7 which lets the air originating from the float 11 escape until the equilibrium of the piston recloses the purge valve 7.

The rods 10 and 3 are adjustable for adjusting the sensitivity of the expander-discharge 20 to the opening of the flush or supply and purge valves.

What is claimed is:

1. A floatability device designed for any submersible entity, capable of being immersed to different depths, and comprising at least one float with a supple membrane filled with gas, and a pressure of said gas is regulated as a function of an immersion depth, wherein:

said membrane is elastic and delimits a space which has a volume which is a function of an elasticity of said membrane and of a relative internal pressure of said space in relation to an external ambient pressure, an expander-discharge system automatically feeds and purges gas to or from said space without intervention from said entity to maintain a preselected volume of said space over a range of depths at which the floatability device is immersed, wherein said relative internal pressure of said space is regulated to be higher than said external ambient pressure so that a pressure differential therebetween is maintained at a constant value that is selectable by said entity, and wherein said preselected volume is adjustable by said entity.

2. The floatability device as claimed in claim 1, wherein said float comprises a rigid base on which said supple membrane is fixed and held, said membrane determining with said rigid base said volume of gas of the float.

3. The floatability device as claimed in claim 2, wherein the rigid base of said float is convex and the membrane is placed against the rigid base prior to filling with gas.

4. The floatability device as claimed in claim 2, wherein the rigid base comprises at least one peripheral groove which cooperates with at least one throat of a counterflange which is fixed on the rigid base outside the groove by sandwiching said membrane.

5. The floatability device as claimed in claim 1, wherein a material from which the membrane is made is such that a modulus of elasticity of the membrane remains substantially constant in a zone at which the membrane is deformed by a differential between a pressure inside of the space and an external ambient pressure, and wherein deformation of the membrane is a function of a relative internal pressure of the float.

6. The floatability device as claimed in claim 1, wherein the expander-discharge system is a supply and gas purge regulator such that a differential between the internal pressure of the space and an external ambient pressure is maintained at a predetermined value.

7. The floatability device as claimed in claim 1, further comprising a plurality of floats capable of being distributed around the submersible entity such that in immersion a center of resulting total thrust of the floats is substantially coincident with a center of gravity of said entity.

8. The floatability device as claimed in claim 1, wherein the expander-discharge system is constituted by a single regulator block in which a purge valve allowing the gas to escape to an exterior of the float is integrated into a pressure-regulating piston which bears a seat of the purge valve and which also ensures control of a supply valve that allows gas into an interior of the float.

9. The floatability device as claimed in claim 8, wherein each purge and supply valve, comprises an integral body with one face of a piston bearing against a closing seat, and, opposing surfaces of the piston are subject to the same downstream pressure because of a borehole made in said piston, the upstream pressure being exerted on a part of lateral faces of the piston.

10. The floatability device as claimed in claim 8, wherein the regulator block comprises:

a first helical spring supported at one of its ends on a first stop solid with the body of the regulator block and adjustable via a roller and at its other end on the piston, which piston is balanced at one side by the first helical spring and the external ambient pressure, and on the other side by the inflation pressure of the float, a second helical spring supported at one of its ends inside the piston and at its other end on the purge valve, the purge valve being limited, in its displacement caused by the thrust of the second spring, by a second stop solid with the body of the regulator block and disposed adjacent the spring, a third helical spring supported at one of its ends against the body of the regulator block and at its other end on the supply valve, the seat of said supply valve being solid with the body of the regulator block.

* * * * *